US008231415B2

(12) United States Patent
Johnescu et al.

(10) Patent No.: US 8,231,415 B2
(45) Date of Patent: Jul. 31, 2012

(54) HIGH SPEED BACKPLANE CONNECTOR WITH IMPEDANCE MODIFICATION AND SKEW CORRECTION

(75) Inventors: Douglas M. Johnescu, York, PA (US); Jonathan E. Buck, Hershey, PA (US); Stephen B. Smith, Mechanicsburg, PA (US); Stuart C. Stoner, Lewisberry, PA (US)

(73) Assignee: FCI Americas Technology LLC, Carson City, NV (US)

( * ) Notice: Subject to any disclaimer, the term of this patent is extended or adjusted under 35 U.S.C. 154(b) by 11 days.

(21) Appl. No.: 12/828,824

(22) Filed: Jul. 1, 2010

(65) Prior Publication Data

US 2011/0009011 A1 Jan. 13, 2011

Related U.S. Application Data

(60) Provisional application No. 61/224,733, filed on Jul. 10, 2009.

(51) Int. Cl.
*H01R 13/514* (2006.01)

(52) U.S. Cl. ..... 439/701

(58) Field of Classification Search ..... 439/701, 439/79, 607.05, 607.07, 108; 29/874; 333/125
See application file for complete search history.

(56) References Cited

U.S. PATENT DOCUMENTS 4,464,003 A 8/1984 Goodman et al.
4,596,428 A 6/1986 Tengler
4,632,476 A 12/1986 Schell
4,655,515 A 4/1987 Hamsher, Jr. et al.
4,705,332 A 11/1987 Sadigh-Behzadi
4,806,107 A 2/1989 Arnold et al.
4,820,169 A 4/1989 Weber et al.
4,824,383 A 4/1989 Lemke
4,836,791 A 6/1989 Grabbe et al.
4,846,727 A 7/1989 Glover et al.
4,854,899 A 8/1989 Matthews
4,882,554 A 11/1989 Akaba et al.
4,952,172 A 8/1990 Barkus et al.
4,975,069 A 12/1990 Fedder et al.
4,975,084 A 12/1990 Fedder et al.
5,046,960 A 9/1991 Fedder
5,066,236 A 11/1991 Broeksteeg
5,083,238 A 1/1992 Bousman
(Continued)

FOREIGN PATENT DOCUMENTS

DE 3529218 2/1986
(Continued)

OTHER PUBLICATIONS

Derman "Speed, Density Push Design Xomplexities," Electronic Engineering Times, May 1998.

(Continued)

*Primary Examiner* — Alexander Gilman
(74) *Attorney, Agent, or Firm* — Woodcock Washburn LLP

(57) ABSTRACT

Disclosed is an electrical connector that includes a dielectric leadframe housing and a differential signal pair of electrical contacts extending through the leadframe housing. The leadframe housing defines an air pocket adjacent to the pair of electrical contacts. The size of the air pocket may be predetermined to provide for no more than a predefined amount of signal skew between the pair of electrical contacts. The size of the air pocket may be predetermined to provide for a predefined connector impedance.

21 Claims, 4 Drawing Sheets

U.S. PATENT DOCUMENTS

| | | | |
|---|---|---|---|
| 5,104,341 | A | 4/1992 | Gilissen et al. |
| 5,117,331 | A | 5/1992 | Gebara |
| 5,224,867 | A | 7/1993 | Ohtsuki et al. |
| 5,228,864 | A | 7/1993 | Fusselman et al. |
| 5,342,211 | A | 8/1994 | Broeksteeg |
| 5,354,219 | A | 10/1994 | Wanjura |
| 5,403,206 | A | 4/1995 | McNamara et al. |
| 5,429,520 | A | 7/1995 | Morlion et al. |
| 5,433,617 | A | 7/1995 | Morlion et al. |
| 5,433,618 | A | 7/1995 | Morlion et al. |
| 5,496,183 | A | 3/1996 | Soes et al. |
| 5,580,283 | A | 12/1996 | O'Sullivan et al. |
| 5,718,606 | A | 2/1998 | Rigby et al. |
| 5,743,765 | A | 4/1998 | Andrews et al. |
| 5,795,191 | A | 8/1998 | Preputnick et al. |
| 5,851,121 | A | 12/1998 | Thenaisie et al. |
| 5,913,702 | A | 6/1999 | Garcin |
| 5,938,479 | A | 8/1999 | Paulson et al. |
| 5,943,770 | A | 8/1999 | Thenaisie et al. |
| 6,027,381 | A | 2/2000 | Lok |
| 6,042,394 | A | 3/2000 | Mitra et al. |
| 6,050,842 | A | 4/2000 | Ferrill et al. |
| 6,083,047 | A | 7/2000 | Paagman |
| 6,113,418 | A | 9/2000 | Kjeldahl |
| 6,206,735 | B1 | 3/2001 | Zanoli |
| 6,244,887 | B1 | 6/2001 | Commerci et al. |
| 6,290,552 | B1 | 9/2001 | Saito et al. |
| 6,347,962 | B1 | 2/2002 | Kline |
| 6,361,376 | B1 | 3/2002 | Onoda |
| 6,371,813 | B2 | 4/2002 | Ramey et al. |
| 6,375,508 | B1 | 4/2002 | Pickles et al. |
| 6,379,188 | B1 | 4/2002 | Cohen et al. |
| 6,431,921 | B2 | 8/2002 | Saito et al. |
| 6,491,545 | B1 | 12/2002 | Spiegel et al. |
| 6,503,103 | B1 | 1/2003 | Cohen et al. |
| 6,517,360 | B1 | 2/2003 | Cohen |
| 6,527,588 | B2 | 3/2003 | Paagman |
| 6,544,072 | B2 | 4/2003 | Olson |
| 6,551,140 | B2 | 4/2003 | Billman et al. |
| 6,602,095 | B2 | 8/2003 | Astbury, Jr. et al. |
| 6,607,402 | B2 | 8/2003 | Cohen et al. |
| 6,623,310 | B1 | 9/2003 | Billman et al. |
| 6,652,318 | B1 | 11/2003 | Winings et al. |
| 6,666,693 | B2 | 12/2003 | Belopolsky et al. |
| 6,692,272 | B2 | 2/2004 | Lemke et al. |
| 6,702,590 | B2 | 3/2004 | Zaderej et al. |
| 6,709,294 | B1 | 3/2004 | Cohen et al. |
| 6,712,646 | B2 | 3/2004 | Shindo |
| 6,739,910 | B1 | 5/2004 | Wu |
| 6,746,278 | B2 | 6/2004 | Nelson et al. |
| 6,814,619 | B1 | 11/2004 | Stokoe et al. |
| 6,872,085 | B1 | 3/2005 | Cohen et al. |
| 6,918,789 | B2 | 7/2005 | Lang et al. |
| 6,979,202 | B2 | 12/2005 | Benham et al. |
| 7,040,901 | B2 | 5/2006 | Benham et al. |
| 7,163,421 | B1 * | 1/2007 | Cohen et al. ..... 439/607.02 |
| 7,316,585 | B2 | 1/2008 | Smith et al. |
| 7,347,740 | B2 | 3/2008 | Minich |
| 7,384,311 | B2 | 6/2008 | Sharf et al. |
| 7,422,483 | B2 | 9/2008 | Avery et al. |
| 7,497,736 | B2 | 3/2009 | Minich et al. |
| 7,588,463 | B2 | 9/2009 | Yamada et al. |
| 2001/0041477 | A1 | 11/2001 | Billman et al. |
| 2001/0046816 | A1 | 11/2001 | Saito et al. |
| 2002/0013101 | A1 | 1/2002 | Long |
| 2002/0106932 | A1 | 8/2002 | Holland et al. |
| 2002/0142629 | A1 | 10/2002 | Zaderej et al. |
| 2002/0173177 | A1 | 11/2002 | Korsunsky et al. |
| 2004/0018757 | A1 | 1/2004 | Lang et al. |
| 2004/0038590 | A1 | 2/2004 | Lang et al. |
| 2004/0072470 | A1 | 4/2004 | Lang et al. |
| 2004/0087196 | A1 | 5/2004 | Lang et al. |
| 2005/0026503 | A1 | 2/2005 | Trout et al. |
| 2007/0021002 | A1 | 1/2007 | Laurx et al. |
| 2007/0099512 | A1 | 5/2007 | Sato |
| 2008/0246555 | A1 | 10/2008 | Kirk et al. |
| 2008/0316729 | A1 | 12/2008 | Rothermel et al. |
| 2009/0011643 | A1 * | 1/2009 | Amleshi et al. ..... 439/608 |
| 2010/0240233 | A1 | 9/2010 | Johnescu et al. |

FOREIGN PATENT DOCUMENTS

| | | |
|---|---|---|
| DE | 3605316 | 8/1987 |
| DE | 4040551 | 4/1993 |
| EP | 0212764 | 3/1987 |
| EP | 337634 | 10/1989 |
| EP | 0442785 | 8/1991 |
| EP | 0486298 A1 | 5/1992 |
| EP | 0560550 | 9/1993 |
| EP | 0562691 | 9/1993 |
| EP | 0486298 B1 | 1/1996 |
| EP | 1111730 | 6/2001 |
| JP | 2007-128706 | 5/2007 |
| WO | WO 96/38889 | 12/1996 |
| WO | WO 02/058191 | 7/2002 |
| WO | WO 02/101882 | 12/2002 |

OTHER PUBLICATIONS

IBM Bulletin, Shielded In-Line Electrical Multiconnector, Aug. 1967, 10(3).

International Application No. PCT/US2003/014370, International Search Report dated Aug. 6, 2003, 2 pages.

International Application No. PCT/US2010/040899, International Search Report dated Jan. 25, 2011, 9 pages.

Siemens, "SpeedPac: A New Concept for the Next Generation of Transmission Speed," Backplane Interconnection, Issue Jan. 1996.

* cited by examiner

HIGH SPEED BACKPLANE CONNECTOR WITH IMPEDANCE MODIFICATION AND SKEW CORRECTION

CROSS-REFERENCE TO RELATED APPLICATIONS

This application claims the benefit of provisional U.S. patent application No. 61/224,733, filed on Jul. 10, 2009, the disclosure of which is hereby incorporated by reference as if set forth in its entirety herein.

BACKGROUND

Right angle electrical connectors may be used to establish a conductive connection between circuit boards, as in coplanar and back-panel configurations, for example. A typical right angle connector may include a connector housing and one or more electrically conductive contacts. The connector housing may be made of a dielectric material, such as a plastic for example. Each electrically conductive contact may be made of an electrically conductive material, such as a metal for example.

The connector housing may contain one or more leadframe assemblies, which may be insert molded leadframe assemblies (IMLAs), for example. An IMLA may be defined as a dielectric leadframe housing through which one or more electrically conductive contacts extends. The leadframe housing may retain the one or more electrically conductive contacts. The leadframe housing may be insert molded over a leadframe of electrically conductive contacts.

Each electrically conductive contact may have a mounting end and a mating end. The mounting end of the electrically conductive contact may be in any configuration suitable for mounting to a substrate. For example, the mounting end may be an eye-of-the-needle configuration. Alternatively, the mounting end may include a solder ball that is suitable for a ball grid array mount. The mating end may be any configuration suitable for mating with a complementary connector. For example, the mating end may be blade shaped or define a receptacle.

In a typical right-angle connector, the mating end of each electrically conductive contact extends in a direction perpendicular to the direction in which the mounting end of the contact extends. Consequently, contacts that are adjacent to one another in a leadframe assembly typically have different lengths. As a result, signal skew may be introduced in differential signals transmitted through a pair of signal contacts that are adjacent to one in the same leadframe assembly. It is desirable to limit the amount of signal skew in the differential signals to an acceptable level. Thus, an electrical connector that provides for no more than a predefined amount of signal skew between such a differential signal pair of electrical contacts would be desirable.

Additional background related to the subject matter disclosed herein may be found in U.S. Pat. No. 5,342,211, entitled "Shielded Back Plane Connector," U.S. Pat. No. 6,379,188 entitled "Differential Signal Electrical Connectors," U.S. Pat. No. 6,918,789, entitled "High-Speed Differential Signal Connector Particularly Suitable For Docking Applications," U.S. Pat. No. 7,163,421, entitled "High Speed High Density Electrical Connector," U.S. Pat. No. 7,347,740, entitled "Mechanically Robust Lead Frame Assembly For An Electrical Connector," and U.S. patent application Ser. No. 12/722,797, entitled "Electrical Connector Having Ribbed Ground Plate." The disclosure of each of the above-referenced U.S. patents and patent applications is incorporated herein by reference.

SUMMARY

As disclosed herein, an electrical connector may include a dielectric connector housing that contains a pair of electrical contacts. The electrical contacts may be stitched, or the connector housing may carry a dielectric leadframe housing through which the pair of electrical contacts extends. The pair of electrical contacts may form a differential signal pair. Alternatively, the pair of electrical contacts may be tip and ring, or any combination of signal contacts and ground contacts.

An air pocket may be defined adjacent to the pair of electrical contacts. The air pocket may be offset relative to the pair of electrical contacts, or to a ground contact positioned adjacent to the pair of electrical contacts, or to a shield embossment positioned adjacent to the pair of electrical contacts.

The pair of electrical contacts may extend along a first direction. The air pocket may be offset relative to the pair of electrical contacts along the first direction. The pair of electrical contacts may extend a first distance along the first direction. The air pocket may extend a second distance along the first direction, with the second distance being greater than the first distance.

The pair of electrical contacts may define a centerline between them. The centerline may extend along a direction that is transverse to the first direction. A centerline of the air pocket may also extend along a direction that is transverse to the first direction. The centerline of the air pocket may be offset from the centerline between the pair of electrical contacts along the first direction.

The air pocket may be defined adjacent to respective first sides of the pair of electrical contacts. Respective second sides of the pair of electrical contacts, that are opposite the first sides, may abut a dielectric leadframe housing. The second sides of the pair of electrical contacts may abut a plastic material from which the leadframe housing is made.

The air pocket may have a size that provides for no more than a predefined amount of signal skew between the pair of electrical contacts. The air pocket may have a size that provides for a predefined differential or single-ended impedance. One of the pair of electrical contacts may be longer than the other of the pair of electrical contacts, as in a right-angle connector, for example. The size of the air pocket may be based, at least in part, on the relative lengths of the pair of electrical contacts.

DETAILED DESCRIPTION

Figure 1:
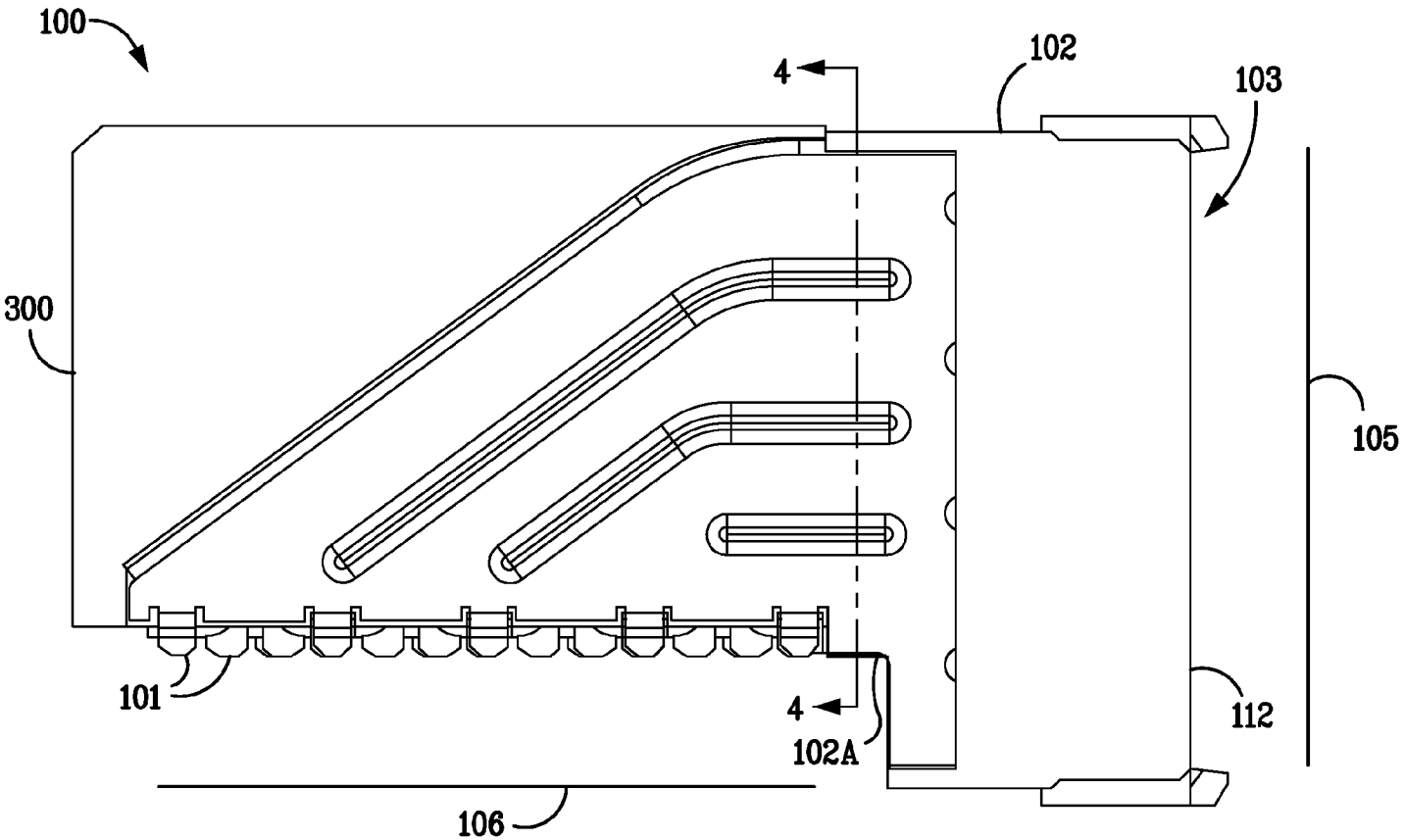
FIG. 1 is a side view of an example right-angle connector assembly.

FIG. 1 is a side view of an example right-angle electrical connector 100 as disclosed herein. The electrical connector

100 may include a connector housing 102 and one or more electrically conductive electrical contacts 101. Each electrical contact 101 may be made of electrically conductive material, such as copper for example. The connector housing 102 may be made of a dielectric material, such as a plastic for example. The connector housing 102 may be injection molded. Though FIG. 1 depicts a right-angle electrical connector 100, aspects of the present invention can also be applied to other types of connectors, such as vertical header connectors, co-planar electrical connectors, and mezzanine electrical connectors, for example.

The connector housing 102 may define a mating portion 103. The mating portion 103 may be suitable for mating with a complementary connector, such as a vertical header (not shown). A vertical header may include stitched electrical contacts or insert molded electrical contacts, and may include an air pocket arrangement such as described herein. The mating portion 103 may be a receptacle mating portion or a header mating portion.

The mating portion 103 may define a mating plane 105 and a mounting plane 106 that is perpendicular to the mating plane 105. For example, the mating plane 105 may be defined by a mating face 112 of the connector housing 102. The mating face 112 may be adapted for mating with a complementary connector (not shown). Also for example, a bottom surface 102A of the connector housing 102 may define the mounting plane 106. The connector housing 102 may contain one or more leadframe assemblies (shown as 300A-D in FIG. 4).

Figure 2:
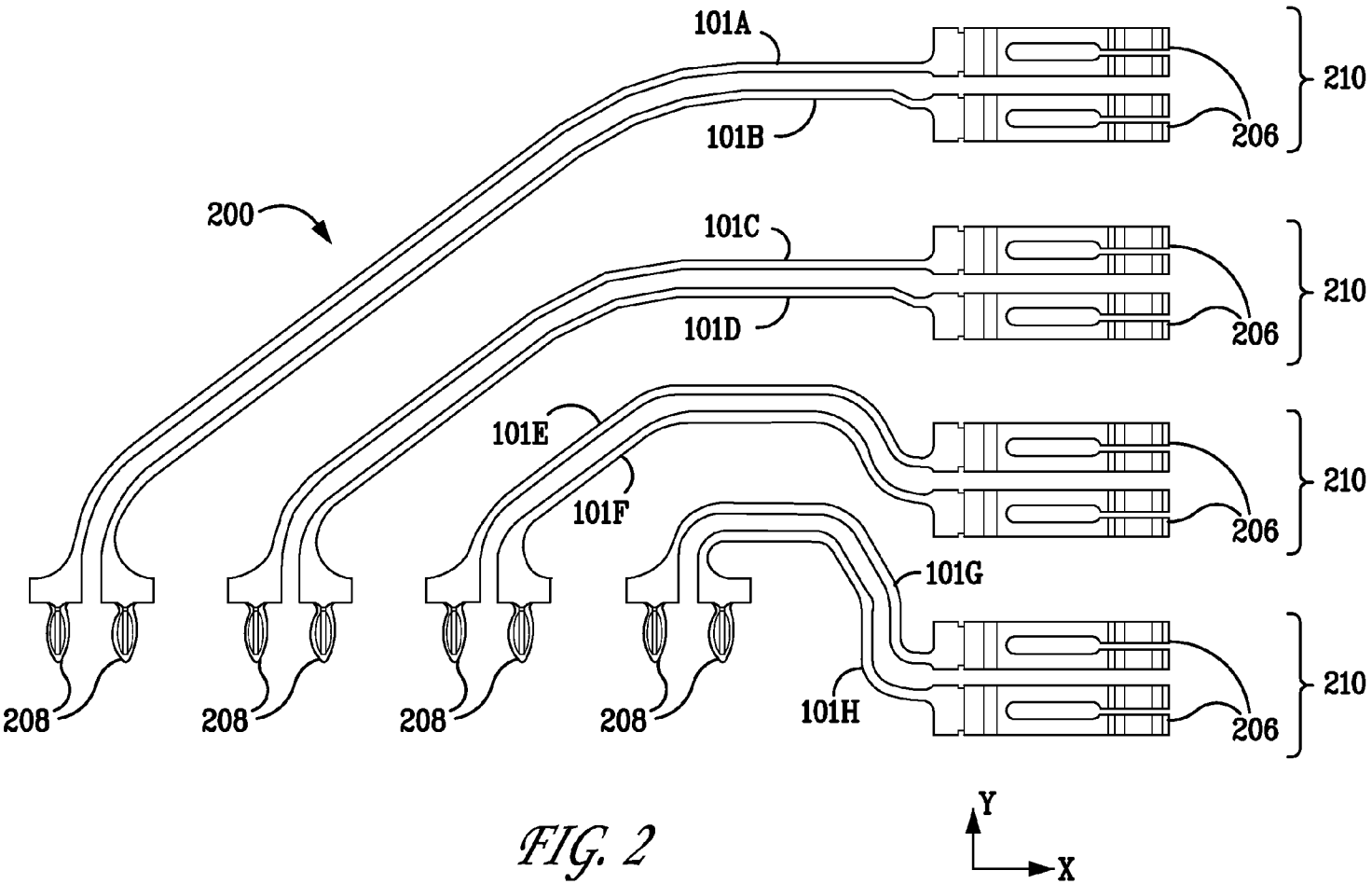
FIG. 2 depicts an example leadframe.

FIG. 2 depicts an example leadframe 200. Four pairs 210 of electrical contacts 101 are shown: a first pair 101A, 101B, a second pair 101C, 101D, a third pair 101E, 101F, and a fourth pair 101G, 101H. Each of the four pairs 210 may function as a differential signal pair or one or more of the electrical contacts 101 may be assigned as low-frequency signal conductors or ground conductors. Each of the four pairs 210 of electrical contacts 101 includes a first, longer electrical contact (e.g., 101A) and a second, shorter electrical contact (e.g., 101B). Accordingly, a differential signal traveling through any of the four pairs 210 shown would be expected to be skewed.

Each electrical contact 101 may have a respective mating end 206, which may be a receptacle (as shown), blade, or other desirable mating end. Each electrical contact 101 may have a respective mounting end 208, which may be an eye-of-the-needle type mounting end (as shown), or a pin, ball, or other desirable mounting end.

Figure 3:
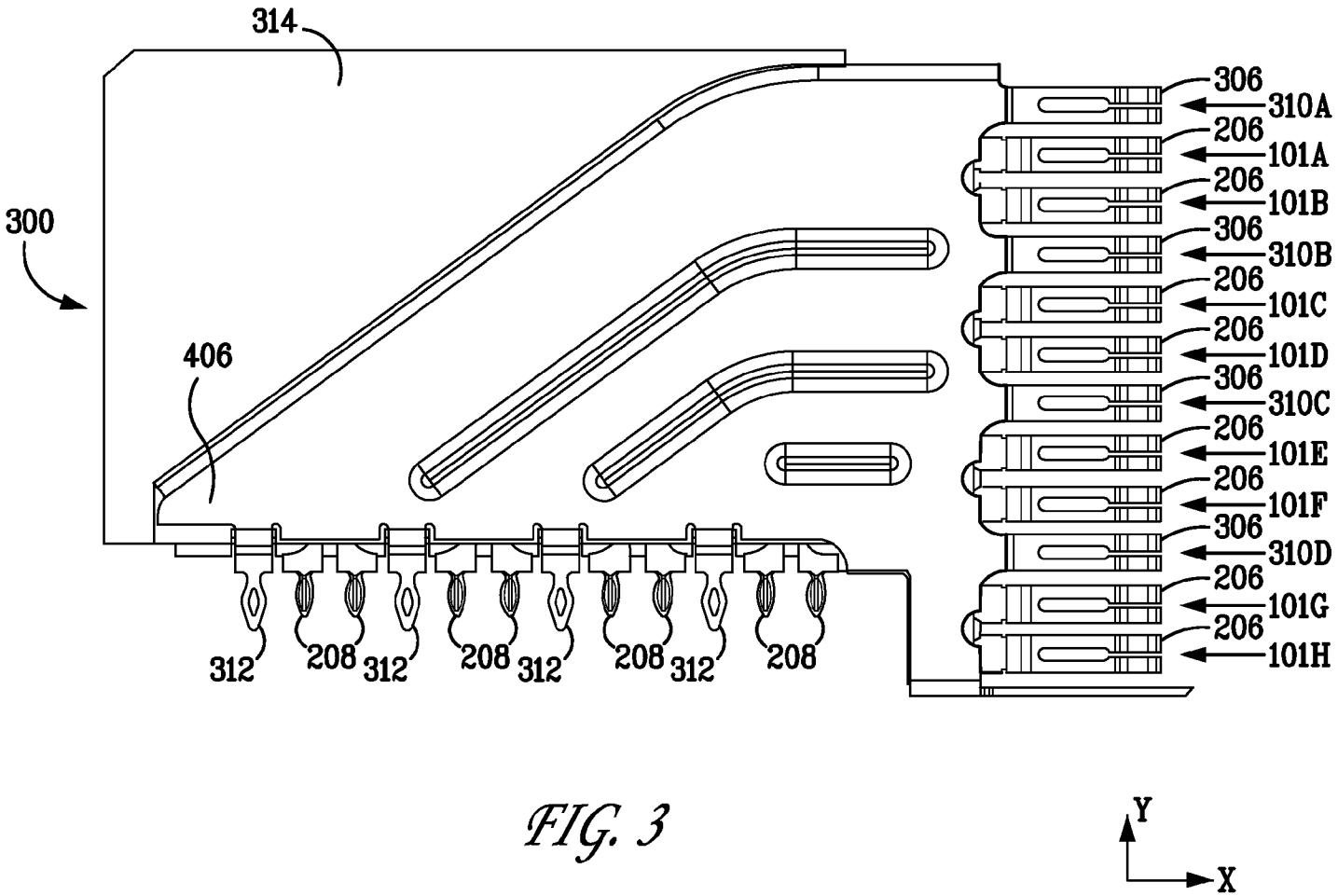
FIG. 3 depicts an example insert-molded leadframe assembly (IMLA).

FIG. 3 depicts an individual leadframe assembly 300. The leadframe assembly 300 may include electrical contacts 101. The embodiment shown in FIG. 3 shows an outer ground contact 310A positioned adjacent one of the outer signal contacts 101A. Ground contacts 310A-D may be part of a ground plate 406 (shown in greater detail in FIG. 4). Each ground contact 310 may have a respective mating end 306, which may be a receptacle (as shown), blade, or other desirable mating end. Each ground contact 310A-D may have a respective mounting end 312, which may be an eye-of-the-needle type mounting end (as shown), or a pin, ball, or other desirable mounting end. A plurality of leadframe assemblies 300 may be held together and spaced apart by a dielectric alignment and retention member 314.

The mating ends 206 of the electrical contacts 101A-H may form a first linear array that extends along a first direction Y. The mating ends 206 of the electrical contacts 101A-H may align along a first common centerline that extends along the first direction Y and is perpendicular to mounting ends 208 of the electrical contacts 101A-H. The mounting ends 208 of the electrical contacts 101A-H may form a second linear array that extends along a second direction X that is perpendicular to the first direction Y. The mounting ends 208 of the electrical contacts 101A-H may align along a second common centerline that extends along the second direction X. The mounting ends 312 of the ground contacts 310A-D may be offset in the first direction from the mounting ends 208 of the four pairs 210 of electrical contacts 101A-H, so that the mounting ends 312 of the ground contacts 310A-D make electrical contact with the circuit board (not shown) before the mounting ends 208 of the electrical contacts 101A-H do.

Figure 4:
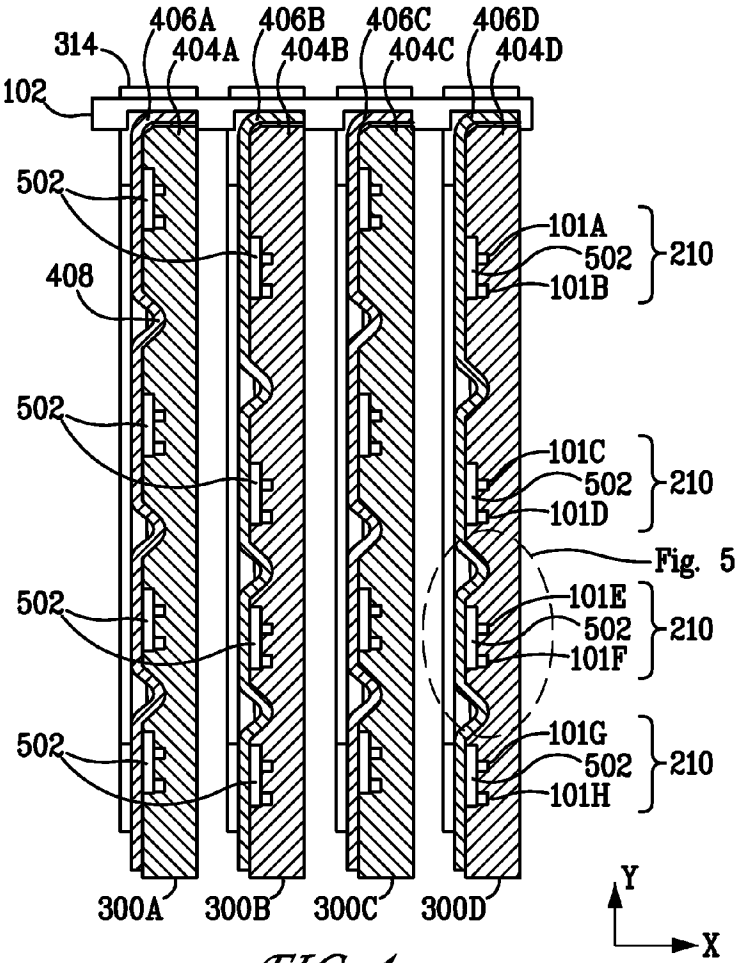
FIG. 4 is a cross-sectional view of the example right-angle connector assembly depicted in FIG. 1, taken along line 4-4 thereof.

As shown in FIG. 4, which is a cross-sectional view of the example connector assembly depicted in FIG. 1, taken along line 4-4 thereof, the connector housing 102 may contain a plurality of leadframe assemblies 300A-D. Each leadframe assembly 300A-D may include a respective dielectric housing 404A-D. Each dielectric housing 404A-D may retain one or more ground plates 406A-D, which may be made from a metal, metalized plastic, or magnetic absorbing material. Each leadframe assembly 300A-D may also be devoid of shields. A dielectric housing 404A-D may be insert molded over a respective leadframe 202 (shown in FIG. 2) of electrical contacts 101A-H.

Each leadframe assembly 300A-D may be an insert molded leadframe assembly (IMLA), for example. A leadframe assembly 300A-D may be defined as a dielectric leadframe housing 404A-D and a leadframe 200 of electrical contacts 101A-H. In each leadframe assembly 300A-D, the electrical contacts 101A-H may extend through a respective dielectric leadframe housing 404A-D. An IMLA may be defined as a leadframe assembly 300A-D in which the dielectric housing 404A-D is insert molded onto a respective leadframe 200 of electrical contacts 101A-H.

Figure 5:
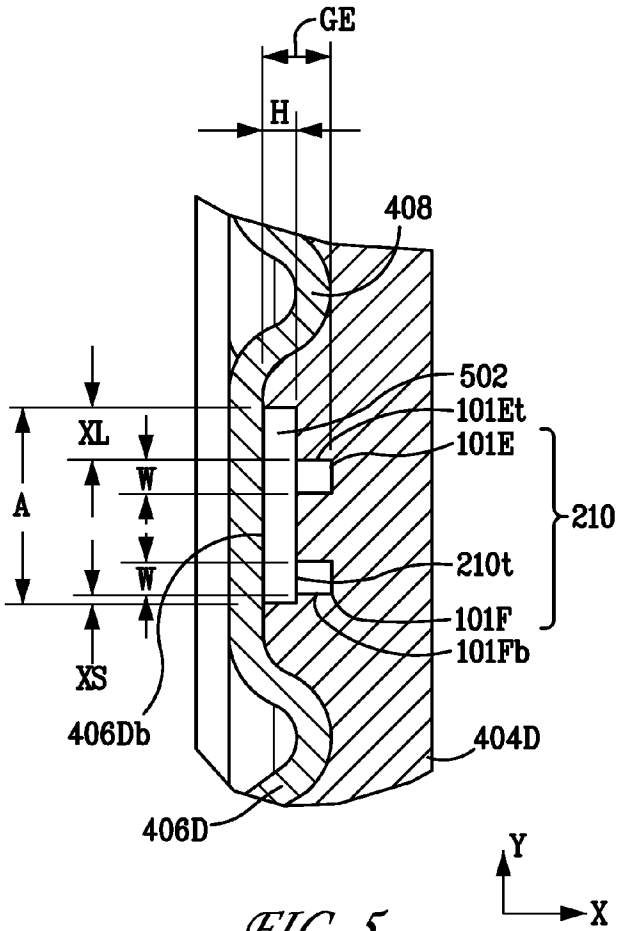
FIG. 5 is a detailed cross-sectional view of a portion of an IMLA depicted in FIG. 4.

FIG. 5 is a detailed cross-sectional view of a portion of the example connector assembly depicted in FIG. 4. As disclosed herein, a leadframe housing 404A-D may define a respective air pocket 502 adjacent to one or more pairs 210 of electrical contacts (e.g., 101E, 101F). The air pocket 502 may be asymmetric, i.e., offset to one side or the other, relative to the electrical contacts 101E, 101F that form the pair 210. Examples of such air pockets 502 may be seen in FIGS. 4 and 5.

It may be noted that the air pockets 502 are not centered evenly with respect to the electrical contacts 101 that form the respective pairs 210. That is, a pair 210 of electrical contacts 101 may extend along a first direction, and the air pocket 502 may be offset relative to the pair 210 of electrical contacts 101E, 101F along the first direction Y. Each air pocket 502 may be offset the same distance XS, XL (see FIG. 5) relative to each respective one of the two or more pairs 210 of electrical contacts 101A-H.

Each of the electrical contacts 101E, 101F extends a respective first distance W along the first direction Y. Each of the electrical contacts 101E, 101F may extend the same distance W along the first direction Y. The air pocket 502 that is adjacent to the pair 210 of electrical contacts 101E, 101F may extend a second distance A along the first direction. The second distance A may be greater than twice the first distance W. The distance A along which the air gap extends may also be greater than the distance between the distal ends 101Et, 101Fb of the contacts 101E, 101F along the first direction Y.

As shown in FIG. 5, an air pocket 502 may be formed on only one side of the pair 210 of electrical contacts 101E, 101F, between the top surface 210*t* of the pair 210 and the bottom surface 406Db of the ground plate 406D. The distance between the top surface 210*t* of the pair 210 and the bottom surface 406Db of the ground plate 406D is shown as "H" in FIG. 5. This allows for the ground plate 406D to be moved closer to the pair 210 of electrical contacts 101E, 101F, which allows for tighter signal-to-ground coupling, better shielding between adjacent pairs 210, and reduced pair-pair cross-talk. The ability to easily change impedance from 100 ohm and 85 ohm can be accomplished by partially filling the air pocket 502 with a dielectric, such as dielectric housing material. Skew compensation can be achieved by shifting the air pocket off center.

Unlike certain prior art connectors, which may have air on both sides of a leadframe 200, a connector assembly 100 as disclosed herein may have an air pocket 502 on only one side of the pairs 210 of electrical contacts 101. Thus, one side of each pair 210 of electrical contacts 101 may be exposed to air pockets 502, while the opposite side may abut the plastic of the dielectric leadframe housing 404A-D. For the same impedance, such an air pocket 502 may allow for tighter spacing between the top surface of the pair 210 and the bottom surface of the ground plate 406D.

The ground plate 406D may have one or more curved portions, or embossments, 408. The embossments 408 may extend a distance GE from the bottom surface 406Db of the ground plate 406D. By moving the ground plate 406D closer to the pair 210, the ground plate embossment 408 may also be moved farther into the leadframe housing 404D along a third direction, which provides for full overlap of the ground plate emboss between pairs 210 of electrical contacts 1010 in the third direction. This increased overlap helps to better contain the radiating fields, thus reducing cross-talk.

A typical problem with right-angle connectors is that having two different physical contact lengths within a pair 210 of differential signal contacts (see, e.g., FIG. 2) causes the electrical signals within the pair 210 to have different time delays, which causes in-pair skew.

As depicted in FIG. 5, the air pocket 502 can be moved so that the shorter electrical contact, such as electrical contact 101F (FIG. 2), is physically closer to a first end of the air pocket 502 (i.e., a distance XS away from the plastic) and the longer electrical contact 101E (FIG. 2) is farther away from the opposite end of the air pocket (i.e., a distance XL away from the plastic). By having a smaller gap between the shorter electrical contact 101F and the plastic of the leadframe housing 404D, the effective dielectric constant for the shorter electrical contact 101F (FIG. 2) may be increased, which increases the time delay for a signal carried through that electrical contact. By adjusting these gaps XS, XL, in-pair skew may be controlled.

Thus, to control in-pair skew in a right-angle electrical connector 100, a design for an electrical connector comprising a leadframe housing 404D and a pair 210 of electrical contacts 101E, 101F extending through the leadframe housing 404D may be provided. The leadframe housing 404D may define an air pocket 502 adjacent to the pair 210 of electrical contacts 101E, 101F, wherein the size and relative offset position of the air pocket 502 relative to the pair of the pair 210 of electrical contacts 101E, 101F is based on the relative lengths of electrical contacts 101E, 101F that form the pair 210.

A size for a specific air pocket 502 that provides for no more than a desired amount of signal skew between the differential signal electrical contacts 101E, 101F that form the pair 210 may be determined. An electrical connector 100 may be manufactured such that the leadframe housing 404D of the manufactured connector 100 defines an air pocket 502 of the determined size adjacent to the pair of 210 differential signal electrical contacts 101E, 101F.

Similarly, the impedance of a right-angle electrical connector may be controlled. The impedance within the right angle section of the connector 100 may be reduced from 100 ohms to 85 ohms by filling the air pocket 502 with plastic. This allows one primary design to meet two design goals by a simple change in tooling of the air pocket feature. Variations of the air pocket 502 can allow adjustments to the impedance. A smaller air pocket placed off center could also allow for tuning of the signal skew within a pair 210 of electrical contacts 101E, 101F at a new impedance value.

A first manufactured connector 100 may be manufactured from the design. The leadframe housing 404D of the first manufactured connector may define an air pocket 502 of a first size adjacent to the pair 210 of electrical contacts 101E, 101F. The first manufactured connector may have a first connector impedance $Z_1$.

A second manufactured connector 100 may be manufactured from the design. The leadframe housing 404D of the second manufactured connector may define an air pocket 502 of a second size adjacent to the pair 210 of electrical contacts 101E, 101F. The size of the first air pocket 502 may be different from the size of the second air pocket 502. The second manufactured connector 100 may have a second connector impedance $Z_2$ that is different from the first connector impedance $Z_1$.

Stated another way, an electrical connector impedance modification method may include the steps of making a first leadframe assembly 300D comprising a differential signal pair 210 of electrical contacts 101E, 101F that each extend through a first dielectric leadframe housing 404D, wherein the first leadframe housing 404D defines a first air pocket 502 adjacent to the pair 210 of electrical contacts 101E, 101F, and the pair 210 of electrical contacts 101E, 101F has an impedance profile of approximately 100±10 Ohms, and making a second leadframe assembly 300D comprising a second differential signal pair 210 of electrical contacts 101E, 101F that each extend through a second dielectric leadframe housing 404D, wherein the second leadframe housing 404D defines a second air pocket 502 adjacent to the pair 210 of electrical contacts 101E, 101F, wherein the second air pocket 502 is smaller than the first air pocket 502, and the second differential signal pair has an impedance profile of approximately 85±10 Ohms.

What is claimed:

1. An electrical connector, comprising:

a dielectric leadframe housing, at least a first differential signal pair and a second differential signal pair each differential signal pair defined by respective first and second electrical contacts that extend through the leadframe housing, the first and second differential signal pairs spaced apart along a first direction; and a ground plate that defines first, second, and third electrically conductive ground members, the first electrically conductive ground member disposed between the first and second differential signal pairs along the first direction, and the second electrically conductive ground member disposed such that the first and second electrical contacts of the first differential signal pair are disposed between the first and second electrically conductive ground members along the first direction, and the electrically conductive ground member disposed such that the first and second electrical contacts of the second differential signal pair are disposed between the second and third electrically conductive ground members along the first direction wherein the leadframe housing defines (i) a first air pocket adjacent to the first and second electrical contacts of the first differential signal pair along a second direction that is substantially perpendicular to the first direction, and the first air pocket does not overlap either of the first and second ground members along the second direction, and (ii) a second air pocket adjacent to the first and second electrical contacts of the second differential signal pair along the second direction, and the second air pocket does not overlap either of the second and third ground members.

2. The electrical connector of claim 1, wherein the first differential signal pair extends a first distance along the first direction, the first air pocket extends a second distance along the first direction, and the second distance is greater than the first distance.

3. The electrical connector of claim 1, wherein the electrical contacts of the first differential signal pair define a first centerline between them, the centerline extending along the second direction, the first air pocket defines a second centerline thereof, the second centerline extending along the second direction, and the second centerline is offset from the first along the first direction.

4. The electrical connector of claim 1, wherein the first air pocket is defined adjacent to respective first sides of the electrical contacts of the first differential signal pair and respective second sides of the electrical contacts of the first differential signal pair opposite the first sides abut the leadframe housing.

5. The electrical connector of claim 4, wherein the second sides of the electrical contacts of the first differential signal pair abut a plastic material from which the leadframe housing is made.

6. The electrical connector of claim 1, wherein the first air pocket has a size that provides for no more than a predefined amount of signal skew between the electrical contacts of the first differential pair.

7. The electrical connector of claim 6, wherein one of the first and second electrical contacts of the first differential signal pair is longer than the other of the first and second electrical contacts of the first differential signal pair, and the size of the first air pocket is based, at least in part, on relative lengths of the first and second electrical contacts of the first differential signal pair.

8. The electrical connector of claim 1, wherein the first air pocket has a size that provides for a predefined connector impedance.

9. An electrical connector impedance modification method, comprising the steps of:

making a first leadframe assembly that includes a first dielectric leadframe housing, a first differential signal pair of electrical contacts that each extend through the leadframe housing, and a ground plate that defines a first pair of embossments that are disposed on opposite sides of the first differential signal pair along a first direction and aligned with the electrical contacts of the first differential signal pair along the first direction, wherein the first leadframe assembly defines a first air pocket that is at least partially defined between the ground plate and the first leadframe housing along a second direction that is perpendicular to the first direction, such that the first air pocket is disposed adjacent to the pair of electrical contacts and the first differential signal pair has an impedance profile of approximately 100±10 Ohms;

making a second leadframe assembly that includes a second dielectric leadframe housing, a second differential signal pair of electrical contacts that each extend through the second leadframe housing, and a second ground plate that defines a second pair of embossments that are disposed on opposite sides of the second differential signal pair along the first direction and aligned with the electrical contacts of the second differential signal pair along the first direction, wherein the second leadframe assembly defines a second air pocket that is at least partially defined between the second ground plate and the second leadframe housing along the second direction, such that the second air pocket is disposed adjacent to the pair of electrical contacts, the second air pocket is smaller than the first air pocket, and the second differential signal pair has an impedance profile of approximately 85±10 Ohms.

10. The electrical connector of claim 9, wherein the pair of electrical contacts extend a first distance along the first direction, the air pocket extends a second distance along the first direction, and the second distance is greater than the first distance.

11. The electrical connector of claim 9, wherein the air pocket is defined adjacent to respective first sides of the electrical contacts, and respective second sides of the electrical contacts opposite the first sides abut the leadframe housing.

12. The electrical connector of claim 11, wherein the second sides of the electrical contacts abut a plastic material from which the leadframe housing is made.

13. The electrical connector of claim 9, wherein the air pocket has a size that provides for no more than a predefined amount of signal skew between the pair of electrical contacts.

14. The electrical connector of claim 13, wherein one of the electrical contacts is longer than the other of the electrical contacts, and the size of the air pocket is based, at least in part, on relative lengths of the pair of electrical contacts.

15. The electrical connector of claim 9, wherein the air pocket has a size that provides for a predefined connector impedance.

16. The electrical connector of claim 9, wherein the first air pocket is further defined between the electrical contacts of the first differential signal pair and the first ground plate, and the second air pocket is further defined between the electrical contacts of the second differential signal pair and the second ground plate.

17. An electrical connector, comprising:

a leadframe assembly including:

a dielectric leadframe housing;

a differential signal pair of electrical contacts extending through the leadframe housing; and a ground plate having a pair of embossments, such that the electrical contacts of the differential signal pair are both disposed between each of the pair of embossments along a first direction and aligned with each of the pair of embossments along the first direction, wherein the leadframe assembly defines an air pocket that is adjacent to each of the electrical contacts, and a portion of the air pocket extends between the electrical contacts of the differential signal pair and the ground plate along a second direction that is perpendicular to the first direction.

18. The electrical connector of claim 17, wherein the air pocket has a size that provides for no more than a predefined amount of signal skew between the pair of electrical contacts.

19. The electrical connector of claim 18, wherein one of the electrical contacts is longer than the other of the electrical contacts, and the size of the air pocket is based, at least in part, on relative lengths of the pair of electrical contacts.

20. The electrical connector of claim 17, wherein the air pocket has a size that provides for a predefined connector impedance.

21. The electrical connector of claim 17, wherein the air pocket further extends between the dielectric leadframe housing and the ground plate along the second direction.

* * * * *